United States Patent [19]

Caron

[11] Patent Number: 4,462,172

[45] Date of Patent: Jul. 31, 1984

[54] QUICK DISCONNECT BLADE TOOL MOUNTING APPARATUS

[75] Inventor: Ronald L. Caron, Auburn, Me.

[73] Assignee: Valley Engineering, Inc., Gray, Me.

[21] Appl. No.: 428,107

[22] Filed: Sep. 29, 1982

[51] Int. Cl.[3] ..... E01H 5/04

[52] U.S. Cl. ..... 37/231; 414/723; 172/817; 37/117.5

[58] Field of Search ..... 37/231, 117.5, 142 A; 414/723, 724, 719–720; 172/810, 817, 828, 830; 403/322, 325; 280/509–510, 515, 483, 485–489

[56] References Cited

U.S. PATENT DOCUMENTS

| | | | |
|---|---|---|---|
| 3,312,004 | 4/1967 | Johnson | 37/142 A |
| 3,985,249 | 10/1976 | Aker et al. | 414/723 |
| 4,116,346 | 9/1978 | Uchida | 414/723 |
| 4,116,347 | 9/1978 | Uchida | 414/723 |
| 4,136,792 | 1/1979 | Wilson | 37/117.5 X |
| 4,187,050 | 2/1980 | Barbee | 414/723 |
| 4,201,000 | 5/1980 | Stanford | 37/117.5 |
| 4,213,731 | 7/1980 | Verachtert | 414/723 |
| 4,243,356 | 1/1981 | Takojima | 37/117.5 X |
| 4,297,074 | 10/1981 | Ballinger | 37/117.5 X |
| 4,311,428 | 1/1982 | Arnold | 414/723 |
| 4,355,945 | 10/1982 | Pilch | 414/723 |

*Primary Examiner*—E. H. Eickholt

*Attorney, Agent, or Firm*—Thompson, Birch et al.

[57] ABSTRACT

An apparatus for detachably connecting a tool component to a frame component which is in turn adapted to be adjustably mounted on a vehicle. One of the components is provided with notched members for receiving engagement members on the other component. Contact members on one component are arranged to compressively engage resiliently compressible pads on the other component during entry of the engagement members into the notched members.

10 Claims, 9 Drawing Figures

QUICK DISCONNECT BLADE TOOL MOUNTING APPARATUS

BACKGROUND OF THE INVENTION

This invention relates generally to devices of the type employed to mount and demount heavy duty tool components on vehicles. The invention is particularly adapted for, although not strictly limited in use to, the mounting of snow plows, scrapers, compactors, etc. on track-propelled vehicles of the type used for establishing and maintaining ski trails.

Such vehicles and their tool components are normally operated at high elevations on steeply sloped terrain, often under extremely adverse weather conditions, thus subjecting the tool mounting arrangements to heavy use accompanied by high stresses. The mounting arrangements must therefore be rugged and wear-resistant, for otherwise they will be subject to frequent breakdowns at locations where repairs are difficult, if not impossible to make. Moreover, there is often a need to rapidly and frequently interchange one tool component for another, and this also must be accomplished under the aforesaid adverse conditions.

In an attempt at dealing with these problems, some prior art tool mounting arrangements have evolved as relatively complex mechanisms. The problem with such mechanisms, however, is that they are either too fragile and thus susceptible to frequent breakdowns, or they are prohibitively expensive. Such mechanisms also experience rapid wear, with attendant loosening and rattling of their component parts. Other more simple arrangements have also evolved, but these require the manual coupling and uncoupling of components parts, which makes it difficult for operating personnel to rapidly interchange one tool for another.

SUMMARY OF THE INVENTION

A basic objective of the present invention is the provision of an improved tool mounting apparatus which obviates or at least minimizes the problems experienced with prior art arrangements.

A more specific object of the present invention is the provision of a tool mounting apparatus which has a rugged simple design that is capable of withstanding the operating stresses experienced under adverse terrain and weather conditions.

Another object of the present invention is the provision of a tool mounting apparatus which can accommodate rapid interchangeability of tools, without the attendant need for manual coupling and uncoupling of component parts.

Still another object of the present invention is the provision of a tool mounting apparatus incorporating resilient means for compensating for the gradual wear of component parts, thereby insuring a tight rattle-free coupling of tools to the vehicle.

These and other objects and advantages of the present invention will be better understood as the description proceeds with the aid of the accompanying drawings, wherein:

DETAILED DESCRIPTION OF PREFERRED EMBODIMENT

Figure 1:
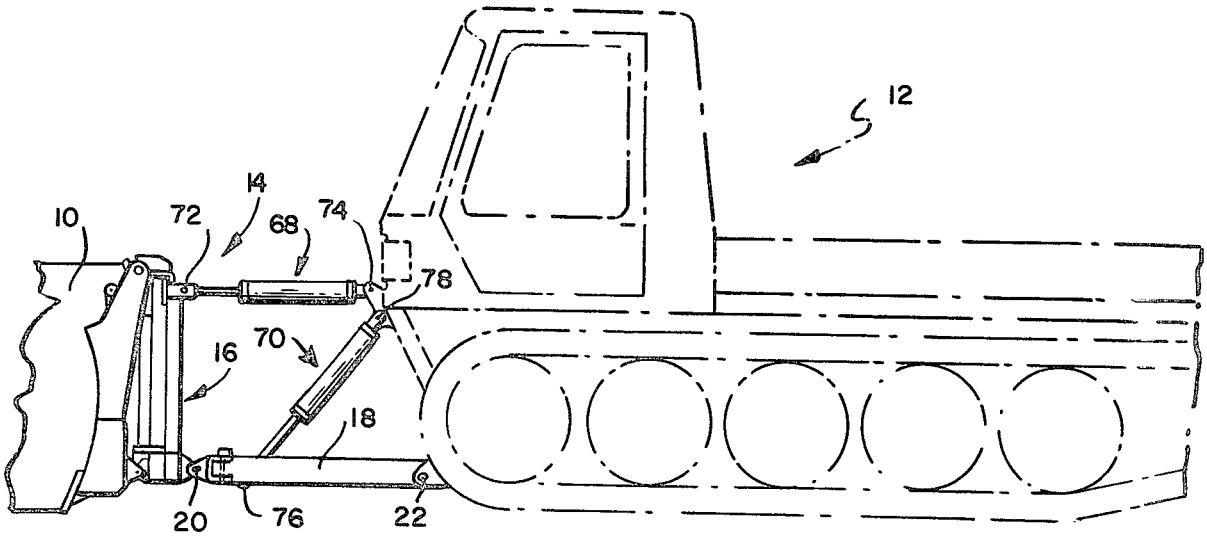
FIG. 1 is a side elevational view of a tool mounting apparatus in accordance with the present invention as employed to detachably connect a snow plow blade to a track-propelled vehicle.
Figure 2:
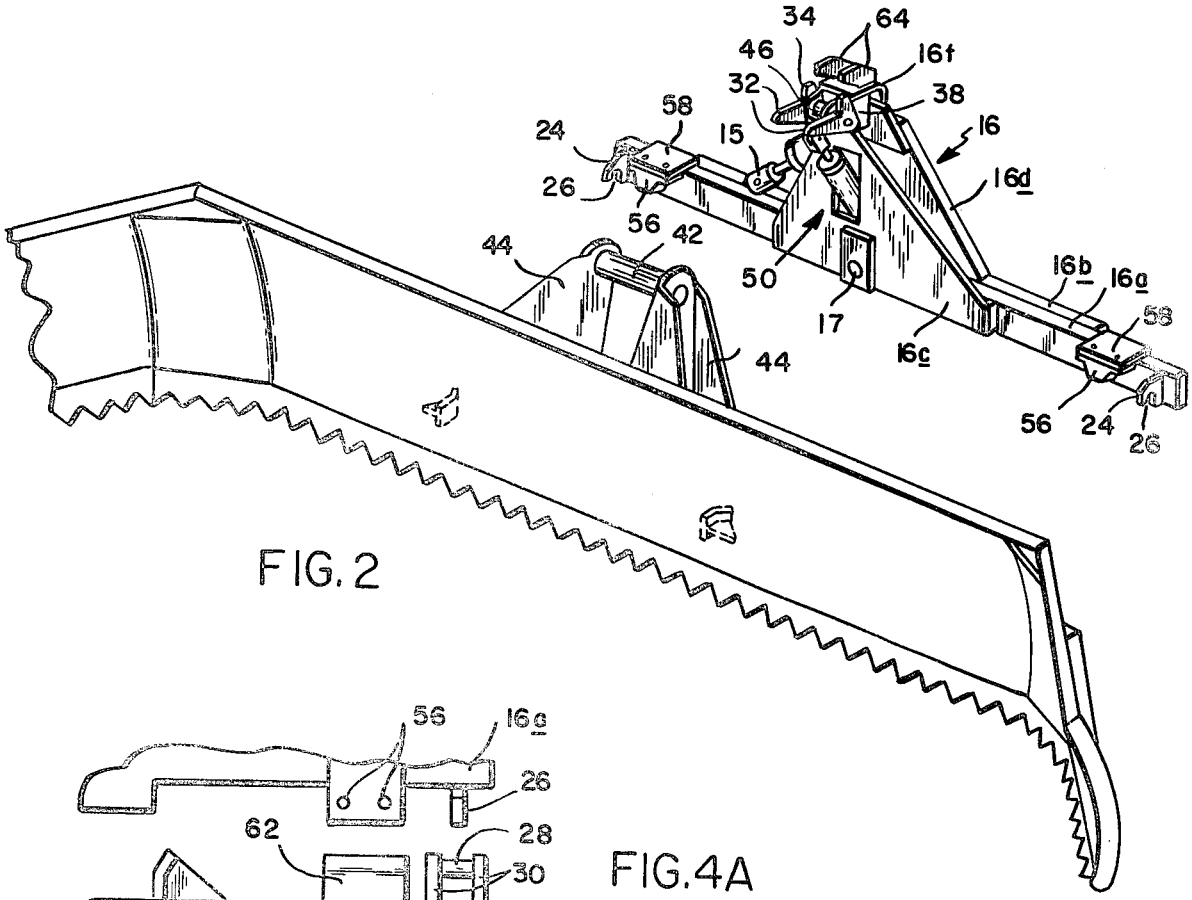
FIG. 2 is a perspective view of the tool mounting apparatus shown separated from the snow plow blade.
Figure 4A:
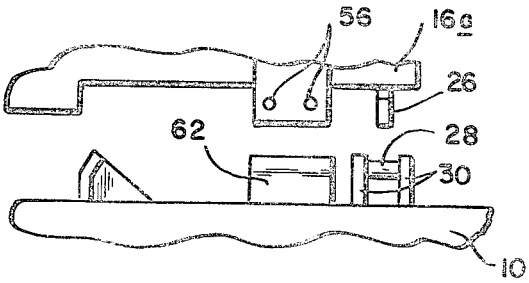
FIG. 4A is a horizontal sectional view taken along line 4A—4A of FIG. 4.
Figure 3:
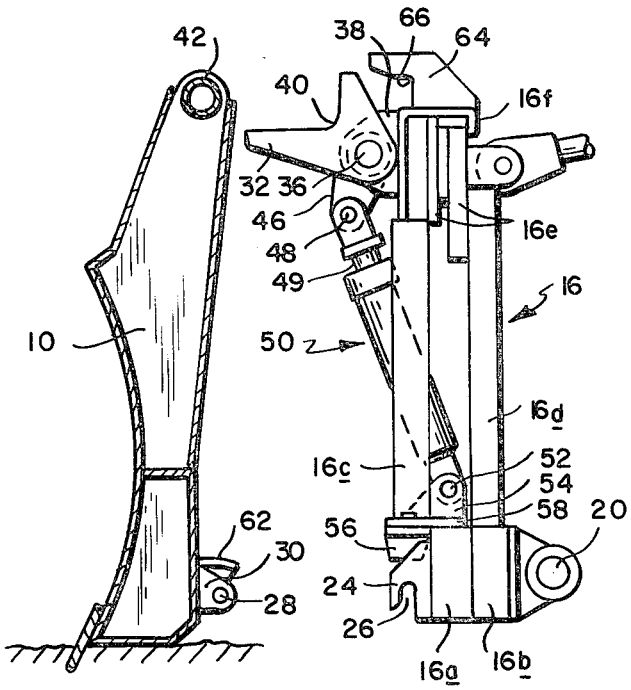
FIG. 3 is a side elevational view, partially in section, of the tool mounting apparatus at a first stage in the procedure employed to couple it to the plow blade.

Referring initially to FIG. 1, a tool component in the form of a snow plow blade 10 is shown detachably mounted to the front end of a track-propelled vehicle 12 by means of a tool mounting apparatus generally indicated at 14. Referring additionally to FIGS. 2 and 3 which show the blade 10 separated from the tool mounting apparatus and resting on the ground, it will be seen that the tool mounting apparatus includes a "frame component" 16 consisting essentially of front and rear horizontal box beams **16*a*, 16*b* which are pivotally joined together at 17, and which respectively support somewhat triangularly shaped vertically upstanding front and rear plates 16*c* and 16*d*. The front and rear plates 16*c*, 16*d* are spaced apart at their upper ends by intermediate components 16*e*, which in turn underlie a cap piece 16*f* extending rearwardly from the front plate 16*c*. The front beam 16*a* and its respective components is pivoted about connection 17 relative to the rear beam 16*b* by means of a piston-cyclinder unit 15**.

The frame component 16 is connected to the front end of the vehicle 12 by an intermediate "link means" generally indicated at 18, the latter being pivotally connected to the rear side of the box beam **16*b* as at 20 and to the front end of the vehicle as at 22. The pivotal connection 20 establishes a horizontal first axis about which the frame component 16** may be inclined, as will be described hereinafter in more detail.

A pair of brackets 24 are secured in a laterally spaced relationship to the front face of the box beam **16*a*. The brackets 24 are notched as at 26 to provide a "first notch means" adapted to interengage with "first engagement means" consisting of pin members 28 extending laterally between brackets 30 secured to the back side of the snow plow 10**.

A pair of locking arms 32 are fixedly interconnected by a sleeve 34 which is in turn rotatably mounted on an axle 36 establishing a second horizontal axis parallel to the first axis established by pivots 20. The axle 36 is supported between brackets 38 extending forwardly from the cap piece **16*f*. As can be best seen in FIG. 3, the arms 32 are notched as at 40 to provide a "second notch means" adapted to interengage with a "second engagement means" in the form of a horizontal bar 42, the latter being supported between brackets 44 on the rear side of the plow blade 10, as is best shown in FIG. 2**.

A "first operating means" includes a crank arm 46 extending laterally from the sleeve 34. The crank arm 46 is pivotally connected as at 48 to the piston rod 49 of a linear actuator in the form of a hydraulic ram 50. The ram cylinder is pivotally connected as at 52 to brackets 54 supported on the front box beam 16*a* of the frame component 16.

Figure 7:
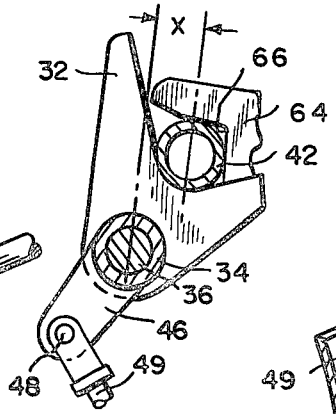
FIG. 7 is an enlarged side elevational view, partly in section, illustrating the interengagement of the second engagement means with the second and third notch means; and, FIG. 8 is an enlarged view showing the interengagement of the first notch means with the first engagement means, as well as details of the relationship between the contact means and the resiliently compressible pad means.
Figure 6:
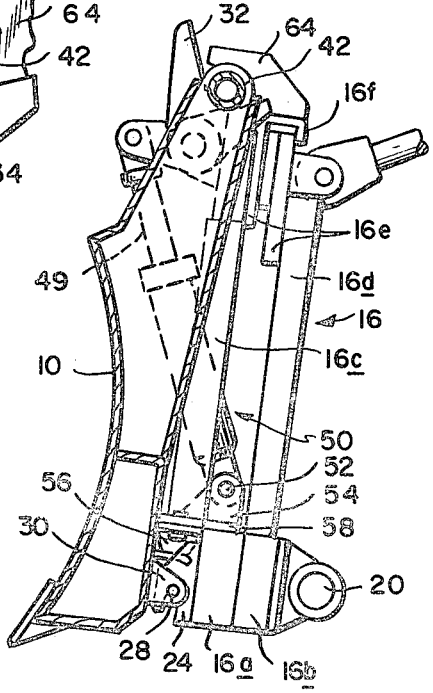
FIG. 6 is another side elevational view showing the final stage in the coupling operation.

Extension and retraction of the piston rod 49 of ram 50 will result in the locking arms 32 being adjusted between an unlocked position at which the notches 40 open in a forward direction transverse to the downwardly open direction of the notches 26 of the lower brackets 24, and a locked position at which their notches 40 open in an upward direction generally opposite to that of the downwardly open notches 26 as shown for example in FIGS. 6 and 7.

A pair of resiliently compressible pads 56 is located on the front side of the box beam 16*a*. These pads, which can conveniently comprise commercially available rubber bumpers, are secured to mounting plates 58 welded to the top of the box beam 16*a*. The pads 56 are removably attached to their respective plates by any convenient means such as for example the bolts 60 shown in FIG. 8, thus facilitating their replacement after normal wear has taken place. The compressible pads 56 are adapted to be compressively engaged by "contact means" in the form of shelf-like plates 62 which protrude rearwardly from the snow plow blade 10.

A pair of vertically protruding plates 64 are mounted on the top of the frame cap 16*f*. The plates 64 are notched as at 66 and as such define "third notch means".

A "second operating means" consisting of hydraulic rams 68 and 70 operates in conjunction with the movement of the vehicle 12 to adjust the position of the frame component 16. The hydraulic ram 68 is pivotally connected to the frame component 16 as at 72 and to the vehicle at 74. Similarly, the hydraulic ram 70 is pivotally connected to the link means 18 as at 76 and to the vehicle as at 78.

Figure 4:
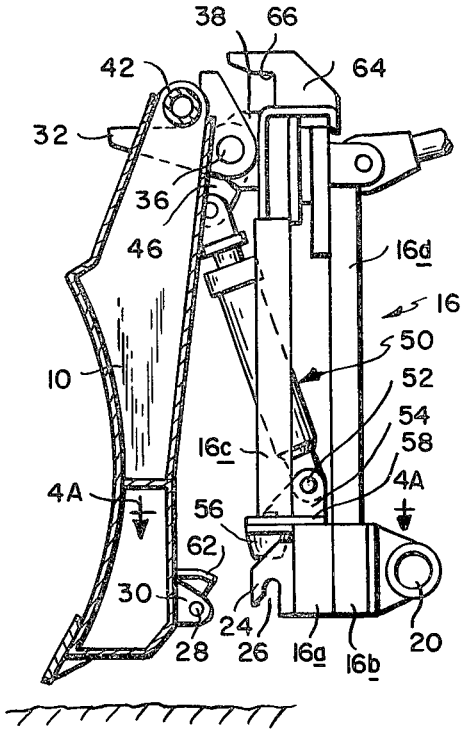
FIG. 4 is a view similar to FIG. 3 showing the next stage in the coupling operation.

When attaching a tool component such as the snow plow blade 10 to the vehicle, the frame component 16 is first brought to a "first position " as shown in FIG. 3. This is accomplished by moving the vehicle 12 to a desired location and by adjusting the elevation of the frame component through appropriate operation of the rams 68, 70. At this first position, the locking arms 32 have been rotated to their unlocked position, with their notches 40 facing the horizontal bar 42 on the plow blade. The lower horizontal edges of the notches 40 extend forwardly of the frame component and are spaced below the level of bar 42. Any inclination of the plow blade and its bar 42 can be compensated for by operating the piston-cylinder unit 15 to incline the front beam 16*a* and its associated components to an appropriate angle. The vehicle 12 is then advanced towards the blade 10 to a point where the horizontal bar 42 is received in the notches 40 of the locking arms 32. Thereafter, the hydraulic rams 68, 70 are operated to elevate the frame component to a "second position" as shown in FIG. 4. At this second position, the plow blade 10 is suspended from the frame component 16 by virtue of the interengagement of the horizontal bar 42 within the notches of the locking arms 32. At this stage, the lower pin members 28 are spaced forwardly of the notched brackets 24, and the contact plates 62 are similarly spaced forwardly of the compressible pads 56.

Figure 5:
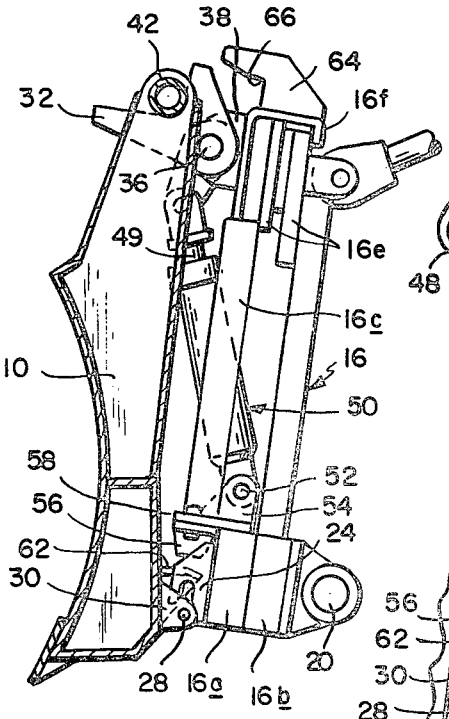
FIG. 5 is another side elevational view showing the next stage in the coupling operation.

The hydraulic ram 68 is next operated to rearwardly incline the frame component 16 about the horizontal axis defined by pivot points 20 to an "elevated inclined third position" as shown in FIG. 5. This has the effect of swinging the lower portion of the plow blade towards the lower portion of the frame component until the lower pin members 28 rest against the bracket 24, thus aligning the pin members with the notches 26. At this stage, the contact plates 62 also are aligned with but spaced below the compressible pads 56.

The hydraulic ram 50 is then operated to rotate the locking arms 32 to the locked position shown in FIG. 6. As the arms 32 rotate, the interengagement of the horizontal bar 42 and the surfaces of the notches 40 causes the blade 10 to move upwardly in relation to the frame component 16 until the bar 42 is securely confined within the notches 40 and 66 between the locking arms 32 and the vertically protruding top plates 64. As this is occurring, the lower pin members 28 are being pulled up into the notches 26 and the contact plates 62 are being drawn into compressible engagement with the pads 56.

Figure 8:
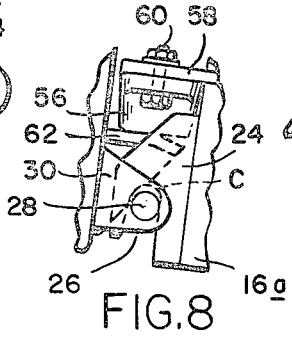

In the final locked position, as can be best seen by a combined reference to FIGS. 7 and 8, the horizontal bar 42 has been moved "over center" by a distance "X", thus establishing a self-locking engagement within the notches 40, 66. The contact plates 62 are in compressible engagement with the pads 56, and the lower pins 28 are confined within the notches 26, there being a small clearance "c" between the pins 28 and the bases of the notches 26.

It will thus be seen that the plow blade 10 is now securely held to the frame 16, with the resilience of the compressible pads 56 acting to compensate for any clearances that might otherwise exist as a result of normal wear of components such as the arms 32, the bar 42, etc. This results in a secure yet rattle-free connection.

The rams 50, 68, 70 are all controllable by known means (not shown) from the vehicle cab. Thus, the vehicle operator can perform the entire mounting sequence without leaving the vehicle cab and without having to manually engage component parts. When detaching the blade from the frame component, the above sequence is simply reversed.

In light of the foregoing, it will now be appreciated by those skilled in the art that minor modifications may be made to the disclosed embodiment without departing from the spirit and scope of the invention. For example, under certain circumstances it may be desirable to reverse the locations of certain cooperating parts. Thus, it might be considered advantageous to locate the compressible pads 56 on the plow blade and the plate members 62 on the frame component. Similar reversals could be achieved with the brackets 24 and pin members 28.

I claim:

1. Apparatus for detachably connecting a tool component to a vehicle, comprising:

(a) a frame component;

(b) link means connecting said frame component to the vehicle, said link means being adapted to accommodate adjustment of said frame component both vertically and angularly about a horizontal first axis;

(c) first notch means fixedly mounted on one of said components and adapted to interengage with first engagement means on the other of said components;

(d) second notch means adjustably mounted on one of said components and adapted to interengage with second engagement means on the other of said components;

(e) first operating means for adjusting said second notch means between an unlocked position opening in a direction transverse to the opening direction of said first notch means, and a locked position opening in a direction opposite to that of said first notch means;

(f) resiliently compressible pad means on one of said components adapted to be compressively engaged by contact means on the other of said components; and (g) second operating means operable in conjunction with vehicle movement for adjusting said frame component between:

(i) a first position at which said components are spaced apart and said second notch means, in its unlocked position, is facing said second engagement means, thereby permitting the vehicle together with said frame component to be advanced towards said tool component until said second notch means and said second engagement means interengage with each other; and (ii) an elevated inclined second position at which the tool component is suspended on said frame component, with said first engagement means and said contact means being respectively aligned with and spaced below said first notch means and said resiliently compressible pad means;

(h) said second notch means being operative upon adjustment to its locked position to cause movement of said components relative to each other, resulting in said first engagement means entering into interlocked engagement with said first notch means, with an accompanying compressive engagement of said contact means against said resiliently compressible pad means.

2. The apparatus of claim 1 wherein first notch means is fixedly mounted on said frame component, and said first engagement means is located on said tool component.

3. The apparatus of claim 1 wherein said second notch means is mounted on said frame component and said second engagement means is located on said tool component.

4. The apparatus of claims 1, 2 or 3 wherein said resiliently compressible pad means is located on said frame component, and said contact means is located on said tool component.

5. The apparatus of claim 1 wherein said second notch means is rotatable about a horizontal axis between said locked and unlocked positions, and wherein said first operating means comprises a linear actuator pivotally connected at opposite ends to said second notch means and its respective supporting component.

6. The apparatus of claim 1 wherein the adjustment of said frame component between said second and third positions occurs about a first horizontal axis, and wherein said second notch means is rotatably adjusted between said locked and unlocked positions about a second horizontal axis which is parallel to said first horizontal axis.

7. The apparatus of claim 1 further comprising a third notch means in which said second engagement means is seated by adjustment of said second notch means to its locked position.

8. The apparatus of claim 1 wherein said first and second notch means are located at vertically spaced levels on said frame component, with said resiliently compressible pad means also being located on said frame component at a level betwween the levels of said first and second notch means.

9. The apparatus of claim 7 wherein when said second notch means is adjusted to its locked position, said second engagement means is firmly confined between said second and third notch means, said contact means is in compressive engagement with said pad means, and said first engagement means is received in but spaced from the base of said first notch means.

10. Apparatus for detachably connecting a tool component to a vehicle or the like, comprising:

a mounting frame;

link means connecting said mounting frame to the vehicle, said link means being adapted to accommodate adjustment of said mounting frame relative to the vehicle both vetically andangularly about a horizontal first axis;

downwardly facing fixed lower notch means on said mounting frame;

an arm member mounted on said mounting frame for rotation about a horixontal second axis, said arm member defining upper notch means;

first operating means for rotating said arm member about said second axis between an unlocked position at which said upper notch means faces towards the front of said mounting frame, and a locked position at which said upper notch means faces upwardly in a direction generally opposite to that of said lower notch means;

resiliently compressible pads on said mounting frame;

upper and lower engagement means and contact means on the tool component;

second operating means for vertically adjusting said mounting frame to a level such that with said arm member in its unlocked position, the base of said upper notch means is below the level of said upper engagement means, thereby permitting the vehicle together with said mounting frame to be advanced to a first position at which the base of said upper notch means underlies said upper engagement means and said lower engagement means is spaced forwardly of and below said lower notch means, said second operating means being further operable to rearwardly tilt said mounting frame about said first axis from said first position to a second position at which said lower engagement means and said contact means respectively underlie said lower notch means and said pads;

whereupon said first operating means then may be employed to rotate said arm member to said locked position, the said rotation causing said tool component to move upwardly relative to said frame to a third position at which said contact means compressively engage said pads and said lower engagement means is received in said lower notch means.

* * * * *